United States Patent [19]

Kesselring

[11] Patent Number: 4,505,398

[45] Date of Patent: Mar. 19, 1985

[54] TEAT

[75] Inventor: Lutz Kesselring, Zeven, Fed. Rep. of Germany

[73] Assignee: MAPA GmbH Gummi- und Plastikwerke, Zeven, Fed. Rep. of Germany

[21] Appl. No.: 460,363

[22] Filed: Jan. 24, 1983

[30] Foreign Application Priority Data

Nov. 12, 1982 [DE] Fed. Rep. of Germany ..... 3241845

[51] Int. Cl.[3] ..... A61J 11/00; A61J 11/02

[52] U.S. Cl. ..... 215/11 B; 215/11 R

[58] Field of Search ..... 215/11 R (U.S. only), 215/11 C, 11 B, 11 D, 11 E, 11 A

[56] References Cited

U.S. PATENT DOCUMENTS

| | | | |
|---|---|---|---|
| 556,859 | 3/1896 | Myrick | 215/11 R |
| 1,146,639 | 7/1915 | Miller | 215/11 B |
| 1,573,519 | 2/1926 | Little | 215/11 R |
| 1,683,246 | 9/1928 | Griffiths | 215/11 R |
| 1,733,184 | 10/1929 | Decker | 215/11 R |
| 1,759,568 | 5/1930 | Fervers | 215/11 R |
| 2,105,170 | 1/1938 | Tarrant | 215/11 R |
| 2,174,361 | 9/1939 | Condon | 215/11 B |
| 2,269,223 | 1/1942 | Porthouse et al. | 215/11 R |
| 2,366,214 | 1/1945 | Ramaker | 215/11 R X |
| 2,388,915 | 11/1945 | Heilborn | 215/11 R |
| 2,588,069 | 3/1952 | Allen | 215/11 R |
| 2,616,581 | 11/1952 | Madsen et al. | 215/11 B |
| 2,699,169 | 1/1955 | Perreault | 215/11 R X |
| 2,709,434 | 5/1955 | Pancoast | 215/11 R X |
| 2,864,520 | 12/1958 | Pitavy | 215/11 R |
| 2,989,961 | 6/1961 | Blanchett | 215/11 R |
| 2,996,207 | 8/1961 | Witz | 215/11 R |
| 3,077,279 | 2/1963 | Mitchell | 215/11 R |
| 3,130,725 | 4/1964 | Griesinger | 215/11 R |
| 3,232,466 | 2/1966 | Turanciol | 215/11 C |
| 3,777,753 | 12/1973 | Kesselring et al. | 215/11 R |

FOREIGN PATENT DOCUMENTS

| | | | |
|---|---|---|---|
| 811132 | 8/1951 | Fed. Rep. of Germany | 215/11 R |
| 6935930 | 2/1970 | Fed. Rep. of Germany | 215/11 R |
| 141386 | 2/1881 | France | 215/11 R |
| 1260680 | 4/1961 | France | 215/11 R |
| 2071325 | 9/1971 | France | 215/11 C |
| 18743 | of 1892 | United Kingdom | 215/11 R |
| 12962 | of 1893 | United Kingdom | 215/11 R |
| 968698 | 9/1964 | United Kingdom | 215/11 R |
| 1018822 | 2/1966 | United Kingdom | 215/11 R |

*Primary Examiner*—William Price
*Assistant Examiner*—Sue A. Weaver
*Attorney, Agent, or Firm*—Toren, McGeady and Stanger

[57] ABSTRACT

A feeding or pacifying teat is provided on its surface with profiled portions consisting of elevations or recesses with respect to adjacent wall portions. At least the body of the teat has an accordion-like wall portion, which is zigzag-shaped in longitudinal section. The tapered portion connecting the body and nipple of the teat has a rough and particularly waffle-like outside surface or is provided on its outside surface with bosses. Additional profiled portions may be provided in the form of the peripherally extending, annular beads and a venting valve.

16 Claims, 14 Drawing Figures

TEAT

Figure 1:
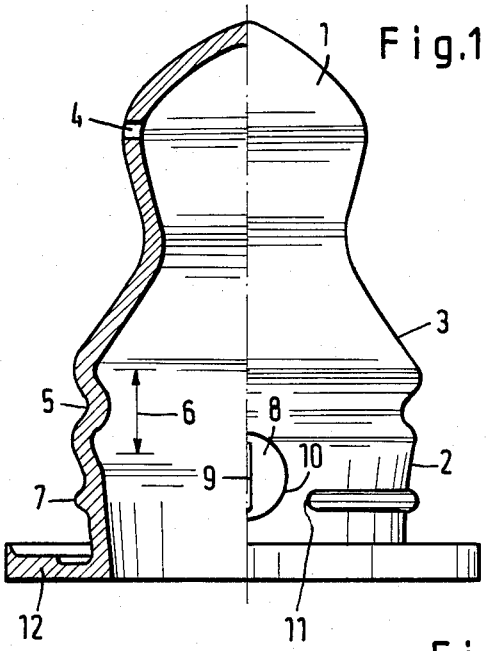

This invention relates to a teat for feeding or pacifying a baby, comprising a teat body, a nipple, and a preferably conical, tapered portion connecting said nipple to said teat body, wherein the wall of the teat is formed with peripherally extending profiled portions.

The invention relates also to such a teat in which the body is formed with a slot, which constitutes a venting valve.

U.S. Pat. No. 1,146,639 discloses a teat which is adapted to be fitted on a bottle and in which the body and nipple of the teat are connected by a portion which has the shape of a segment of a sphere. The nipple is formed with an opening for drinking. The domelike portion which connects the teat body and nipple is formed with internal reinforcing beads, which terminate at a peripherally extending annular bead formed on the inside surface of the teat body. These beads consist of ribs and constitutes a stiffening skeleton, which prevents the teat from collapsing or yielding, particularly because the top ends of the ribs terminate at a peripherally extending, annular bead provided on the inside surface of the teat at the lower end of the nipple. An arch is virtually formed, which stiffens the teat so that the vacuum created at the nipple is directly applied to the contents of the bottle whereas the body of the teat does not yield. Owing to that stiffnes, the teat is not comfortable in use.

That known teat comprises also a venting valve adjacent to the domelike portion between the teat body and the nipple. The venting valve consists of a slot, which is disposed between the profiled stiffening portions and is formed in an interal projection beside recesses formed in the inside surface of the teat body. This arrangement adversely affects the function of the teat particularly when the domelike connecting portion is internally stiffened.

It is an object of the invention so to improve a teat which is of the kind described first hereinbefore that a certain strength is combined with such a yieldability that the teat within limits simultates the mother's breast but an inversion of the teat when used to feed a baby will be prevented.

This object is accomplished according to the invention that the teat has profiled portions which on the outside surface of the teat constitute projections and/or recesses with respect to adjacent wall portions and include at least one recess formed in the outside surface of said teat body.

The projections and recesses on the outside surface improve the grip of the teat. Particularly the recesses formed in the outside surface of the teat ensure that adjacent wall portions can be infolded only to a limited extent and that the yieldability is restricted and the teat cannot be inverted. That object is also accomplished by the provision of beads on the outside surface. It must be born in mind that the extensibility of a given material is limited but exceeds its compressibility.

In a particularly preferred embodiment at least one peripherally extending recess formed in the outside or inside surface is defined by a wall portion which is zigzag-shaped in longitudinal section. This ensures that the teat body can be folded to a predetermined shape so that the teat body can adapt itself to a deflection of the nipple and a certain grip is imparted to the teat.

From this aspect, a teat according to a preferred embodiment has at least in its body an accordianlike wall portion which is zigzag-shaped in longitudinal section.

Another feature, which can be combined with the feature described in the last preceding paragraph, restricted to the tapered portion, resides in that the zigzag-shaped wall portion of the teat body and comprises, at most, two such peripherally extending profiled portions.

In a desirable embodiment there is only one recess, which is outwardly open so that the adjacent wall portions can fold against each other and prevent an inversion of the teat.

In a preferred embodiment, a projection is provided beside the recess formed in a wall portion which is zigzag-shaped in longitudinal section. That projection improves the stiffness because in case of a tendency of the teat to become inverted the tensile stress will increase from the outside so that said tendency will be opposed.

A special advantage will be obtained if the recess is defined by wall portions which meet at an angle. The preshaping of the transition between such wall portions will result in a stable shape. This stability can be further improved if the outwardly facing flute is defined by wall portions having a larger thickness as a result of an aggregation of material.

Also within the scope of the invention, at least one profiled portion consists of an external, peripherally extending, annular bead, which is particularly provided in addition to other profiled portions and will influence the stress on the outside surface. Whereas the provision of such bead maintains certain resilient properties simulating the mother's breast, an inversion of the teat will be prevented. Particularly, a slipping of the mouth of the baby over the teat to an excessive extent will be prevented because such slipping will be resisted by the external bead.

According to a particularly advantageous feature, the teat has zigzag-shaped wall portions which define outwardly open recesses and have the same wall thickness everywhere. That design will prevent a bellows-like infolding and a soft resilience.

In a particularly preferred embodiment, the outside surface is waffle-shaped adjacent to the tapered portion and is formed there with crossing grooves. This results in an embodiment which has a particularly firm grip and simultates the external shape of a mother's breast so that the utility of the teat will be improved. Certain resilient properties are obtained by the same measure and will particularly render more difficult or virtually prevent an inversion of the teat because the projections will move into engagement with each other.

The wafflelike surface comprises quasi-square fields. In a preferred embodiment, grooves are provided which define diamond-shaped fields which have opposite corners that are acute-angled or obtuse-angled. That design will improve the strength in a certain direction because the teat can be more easily compressed in the direction of the minor axis of each field than in the direction of its major axis. A zigzag-shaped wall portion may preferably be provided on its outside surface with a diamond pattern in which the major axis of each diamond shaped field extends in the peripheral direction. That design will desirably result in a yieldability which simulates the mother's breast and will permit of a limited twisting. Besides, that diamond pattern will permit a certain compression and translation of the nipple.

The grooves are desirably formed by a deformation of the wall of the teat so that said wall has the same thickness also at the grooves and is formed with internal beads corresponding to the grooves. Alternatively, the grooves may be formed in that the wall thickness is reduced. The provision of a uniform wall thickness is reduced. The provision of a uniform wall thickness will afford the above-mentioned advantages of a higher strength.

If the above-mentioned diamond pattern is provided on the teat body on the accordionlike wall portion which is zigzag-shaped in longitudinal section, a wafflelike configuration will preferably be provided on the accordionlike tapered portion.

If the diamond pattern is provided also on the tapered portion, the diamond pattern will have a relatively small volume so that in that portion, which is contacted by the lips and in an orthodontic teat has a shaping function, the basic configuration of the orthodontically effective surface will be preserved.

It will be understood that a wafflelike or diamond pattern can be used also in the other embodiments described hereinbefore which have no accordionlike wall portion and a pattern of diamond-shaped fields having radially extending major axes may be provided on the tapered portion.

In a particularly preferred modification, bosses are provided on the outside surface of the tapered portion of the teat. Such bosses may be provided on the tapered portion at points which are distributed at random. The bosses have a substantially circular cross-section at the base and from that base project substantially in the shape of a segment of a sphere so that a slightly roughened nipple of the breast is simulated.

In combination with the above-mentioned recess, the teat of the preferred embodiment of the teat is provided at the lower end of the tapered portion with a peripherally extending, annular bead, which preferably constitutes an extension of the downwardly and outwardly extending wall portion. This feature results in a stiffening of the teat below the recess so that the latter acts like a hinge, which permits a deflection of the nipple relative to the bottleneck in adaptation to the mouth of the baby whereas there is no risk of a collapsing of the teat. The above-described pattern of radially extending, diamond-shaped fields affords the advantage that the teat can yield to some extent in the peripheral direction.

In a particularly preferred embodiment, the slot of the above-mentioned venting valve opens into a gap formed in the bead. As a result, the external bead which is interrupted by the gap will influence the edge of the slot which constitutes the venting valve so that the latter will respond with a higher sensitivity than in known embodiments because wall portions of the teat adjacent to the valve have a higher resistance to deformation and cannot yield inwardly to the same extent as thinner wall portions provided adjacent to the valve in known embodiments. That desirable influence will particularly be obtained if the slot extends parallel to the longitudinal axis of the teat and will be assisted if the slot is formed at the center of a depression.

Within the scope of the invention a profiled portion may consist of a thinner wall portion which is formed at least in the body of the teat and defines a groove on the outside surface. An external groove acts to some extent as a hinge, which in case of a vacuum applied to the inside surface of the adjacent wall portions may permit only the edges of the thinner wall portions to be drawn inwardly so that a desirable resilient response is ensured but its effect will be restricted. In a desirable embodiment, a plurality of peripherally extending, thinner wall portions define respective grooves on the outside surface of the body of the teat and/or of the tapered portion. An inversion of the body will be reliably prevented even when a plurality of such thinner wall portions defining external grooves are provided.

The references made hereinbefore to profiled portions includes also profiled portions which define external recesses radiating from the lower end of the nipple and are formed at least in the tapered portion. These radiating profiled portions will also produce the above-mentioned results consisting of a restricted yieldability. Within the scope of the invention the nipply may be formed with a suction or drinking opening; in that case the teat constitutes a feeding teat and may be provided with a peripherally extending flange at the lower end of the teat body. Such flange may be gripped in known manner between the rim of a bottleneck and a cap nut.

The invention is also applicable to a teat which is provided with a curled rim at the lower end of the teat body and can be slipped onto a bottleneck.

Figure 2:
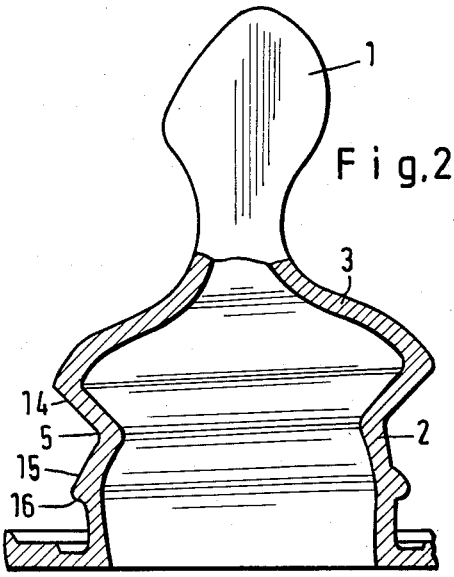
Figure 3:
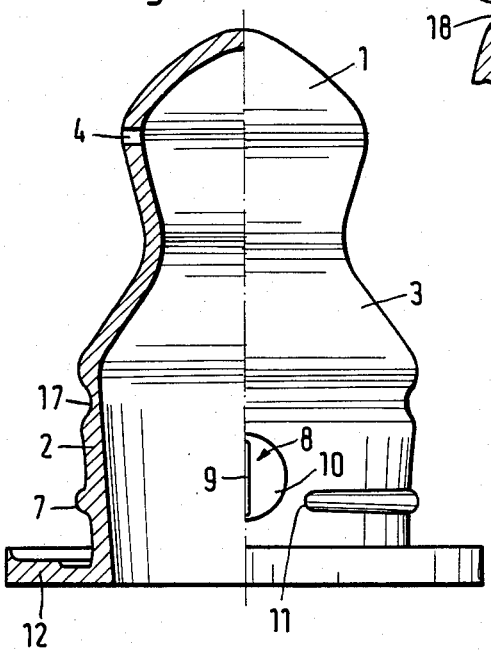
Figure 6:
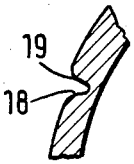
Figure 5:
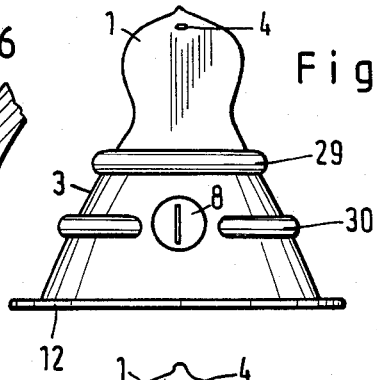
Figure 4:
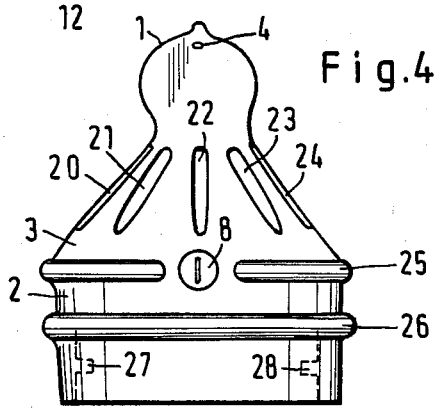
Figure 1A:
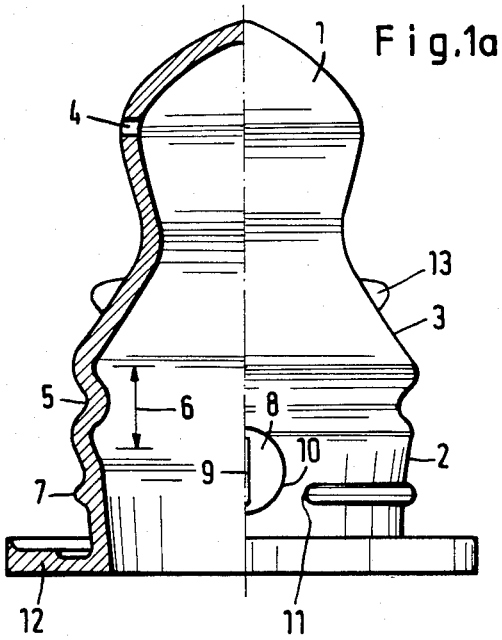
Figure 7:
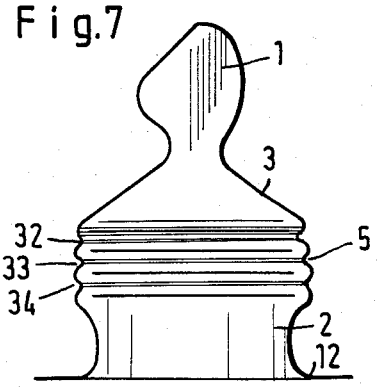
Figure 8:
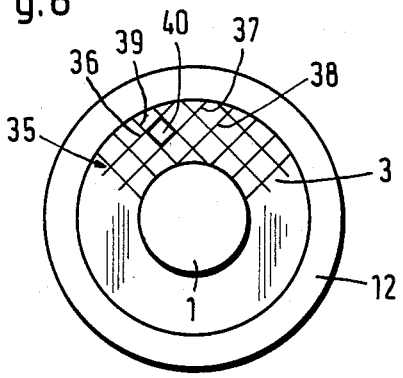
Figure 9:
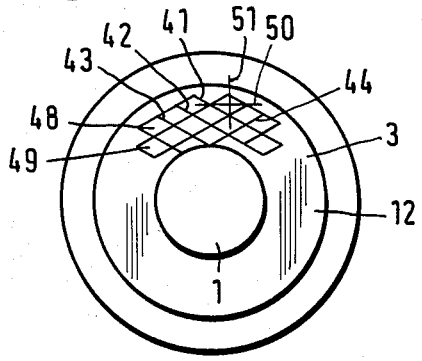
Figure 10:
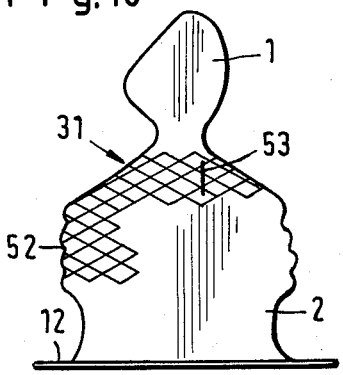
Figure 11:
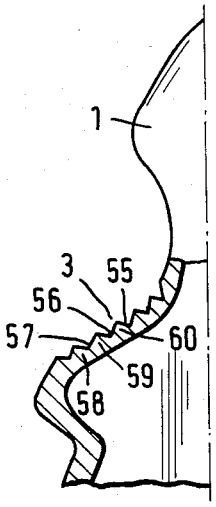
Figure 12:
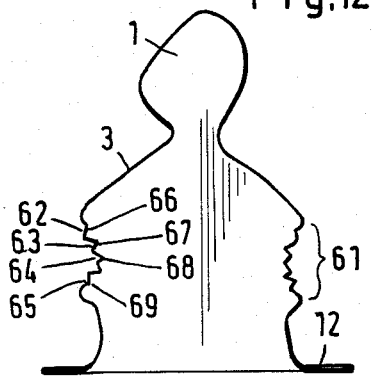
Figure 13:
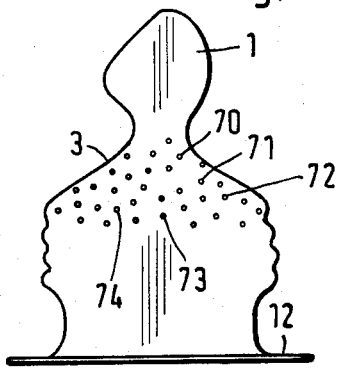

The invention will now be described more fully with reference to illustrative embodiments shown on the drawings, in which FIG. 1 is a side elevation showing partly in section a flanged teat, FIG. 1*a* is a side elevation illustrating an alternate arrangement of the embodiment shown in FIG. 1, FIG. 2 is side elevation showing partly in section another embodiment of a flanged teat, FIG. 3 is a side elevation similar to FIG. 1 and shows a further embodiment, FIG. 4 is a side elevation showing partly in section a teat which can be slipped onto a bottleneck and embodies additional features, FIG. 5 is also a side elevation showing a flanged teat of a further embodiment, FIG. 6 is a fragmentary view showing a wall portion of the teat in order to illustrate a modified external groove, FIG. 7 is a side elevation which is similar to FIG. 1 and shows a further embodiment, FIG. 8 is a top plan view showing a teat of a special embodiment, FIG. 9 is a top plan view which is similar to FIG. 8 and illustrates a modification, FIG. 10 is a side elevation showing a teat having a special accordionlike wall and superimposed patterns formed on the outside surface of the teat, FIG. 11 is a fragmentary vertical sectional view showing a teat of a different embodiment, FIG. 12 is a side elevation showing a teat according to a still further embodiment, and FIG. 13 is a side elevation showing a teat according to a further embodiment.

All parts are designated with the same reference characters in all figures of the drawings.

The teat shown in FIG. 1 is a feeding teat comprising a flange and having at its upper end a nipple 1, which is connected to the teat body 2 by an upwardly and inwardly tapered portion 3, which is substantially conical although it may alternatively be curved in longitudinal section. The nipple 1 is formed with a drinking opening 4

Near the transition between the tapered portion 3 and the inwardly and downwardly tapering teat body 2, the latter is formed near its upper end with a peripherally extending, profiled portion, which defines a recess 5 and constitutes a portion of a zigzag-shaped wall portion 6 of the teat body. In the illustrative embodiment shown in FIG. 1, the wall portion 6 has a uniform wall thickness so that the teat can be compressed to a restricted extent by vertical pressure applied to the nipple and the latter can be deflected to one side or the other at the same time. A wall having the longitudinal sectional shape shown in FIG. 1 will prevent a substantial compression of the teat body. The restricted compressibility which is desired should simulate a firm breast of the mother. Even if the teat body has a small wall thickness, the stability can be improved in that a peripherally extending annular external bead 7 is provided below the wall portion 6. That bead is substantially closed but in the embodiment shown, in which the teat body is provided with a venting valve 8 consisting of a slot 9, which is particularly formed in a depression 10, the peripherally extending, annular bead is interrupted to form a gap, and the depression opens into said gap. One end 11 of the bead is apparent from FIG. 1.

The teat which has been described thus far is provided with a peripherally extending annular flange 12 at the lower end of the teat body 2.

It will be understood that additional peripherally extending annular beads may be formed on the teat body 2 and the tapered portion. Such a bead is shown in FIG. 1*a* and on the tapered portion 3 and it is apparent that such a bead will stiffen the tapered portion against inversion.

In the embodiment shown in FIG. 2, the teat has an orthodontic nipple and the teat body is formed near its upper end with a recess 5. Whereas in the embodiment shown in FIG. 1 the transition between the wall portions defining the recess 5 is arcuate in longitudinal section, the wall portions 14, 15 which define the recess 5 in the embodiment shown in FIG. 2 meet at an angle. This design will assist the tendency of the nipple 1 to align its longitudinal center line with that of the teat body 2. The stability will be further improved by the provision of peripherally extending, annular bead 16 on the outside surface of the wall portion 15 at the lower edge of the recess 5.

In the teat shown in FIG. 3, the teat body 2 is formed near its upper end with a profiled portion which is smaller in wall thickness and defines a peripherally extending, annular groove 17. Such an outwardly open groove could also be formed in the tapered portion 3 and affords the advantage that an inward bending of wall portions adjacent to the groove will be facilitated because such wall portions can deform outwardly to an angled shape and the inside surface of such wall portion of the teat body will thus be stressed. But as the tensile stress which can be applied to the opposite side of the teat body is restricted, there will be only a slight deformation, and, in case of a partial collapsing to simulate the response of the mother's breast, only a slight compression because the wall portions defining the groove approach and finally engage each other. The yieldability which is thus provided is restricted and can be controlled by the selection of the cross-sectional shape of the groove. The groove 17 is semicircular in cross-section. The grooves may be wedge-shaped or, as shown in FIG. 6, may be defined by convex surfaces 18, 19 disposed on opposite sides of the groove. That design will afford the advantage that a circumferential contact will involve only a small work consumed by friction.

In the slip-on teat shown in FIG. 4, the tapered portion 3 is formed with recesses 20 to 24, which radiate from the lower end of the nipple 1. This design produces the results described hereinbefore that the yieldability is restricted by the provision of an external concave recess. The embodiment shown in FIG. 4 affords the additional advantage that the increased resilience of wall of the tapered portion adjacent to the recesses permits a twisting of the nipple 1 relative to the teat body 2. It will be understood that in this embodiment the teat body may also be formed with peripherally extending, annular external beads 25, 26 as has been described hereinbefore, and a venting valve 8 may be provided in a wall portion on which one of said beads is interrupted.

The slip-on teat shown in FIG. 4 has a lower end portion 27 formed with profiled portions 28 consisting of internal ribs for retaining the teat, e.g., on a bottleneck.

In the flanged teat shown in FIG. 5, the tapered portion 3 is formed on the outside with two peripherally extending, annular beads 29, 30 and a venting valve 8 may be provided adjacent to one of said beads. The provision of the beads on the tapered portion 3 affords the advantage that the stiffness of the tapered portion which is due to its conical shape is increased on several levels in the peripheral direction so that the tapered portion can yield but its yieldability is restricted. The beads have surfaces which are engageable with each other so as to resist an elastic compression or expansion.

A particularly desirable embodiment is shown in FIG. 7. In that embodiment the tapered portion 3 is substantially smooth and the teat body has a wall portion which defines an external recess 5 and in that recess has an accordionlike, zigzag shape owing to the provision of, e.g., three external grooves, 32, 33, 34, which are shown on an exaggerated scale in FIG. 7 for the sake of clarity. Generally the teats are shown on an enlarged scale in the drawing. The embodiment shown in FIG. 7 is preferred because the response of a mother's breast is simulated owing to the provision of shallow recesses in a portion which has a uniform wall thickness. The tapered portion may be provided with a wafflelike pattern as is indicated at 35 in FIG. 8. By that pattern, the surface of the tapered portion 3 will be roughened but will not otherwise be affected. Reference is made in this connection to the embodiment which will be described with reference to FIG. 13.

Another advantage afforded by the provision of peripherally extending, annular external beads resides in an improved grip of the teat particularly for a small child and in an entranced simulation of a sucking from the natural source.

FIGS. 8 and 9 are top plan views showing a teat having a nipple 1 and a tapered portion 3. In the teat shown in FIG. 8, the tapered portion 3 is formed on its outside surface with a wafflelike pattern 35 consisting of crossing grooves 36, 37, 38, 39 . . . , which define substantially rectangular fields, one of which is designated 40.

In the teat shown in FIG. 9, the tapered portion 3 is formed with grooves 41, 42, 43, 44 intersecting at oblique angles and defining diamond-shaped fields, which are designated 48, 49, for instance. Each of these diamond-shaped fields has a major axis 50 and a minor axis 51. It will be understood that these grooves formed in the tapered portion 3 may consist of incisions or folds and the resistance of a tapered portion 3 formed with such grooves to compression is higher in the direction of the major axis 50 than in the direction of the minor axis 51. In one embodiment, the major axis of each of the diamond-shaped fields defined by the grooves in the tapered portion extends in the peripheral direction, whereas the minor axis extends radially. That concept may also be adopted in the embodiment shown in FIG. 7 and will have the result that the grooves which define the fields and which may be substantially wedge-shaped in cross-section will not only ensure that the stiffness of the tapered portion differs in different directions but will also prevent a collapsing of the tapered portion.

The teat shown in FIG. 10 is formed in its body 2 with a peripherally extending, annular profiled portion, which consists of accordionlike folds. That design is combined at least on the outside with grooves in a diamond pattern for improving the grip. The minor axes 53 of the diamonds extend radially. This design will permit a certain twisting of the nipple 1 and will improve its compressibility and the mother's breast will be even more closely simulated.

It will be understood that crossing grooves may also be formed on a substantially smooth outside surface, as is shown in FIG. 1, and that in such case even the recess 5 and the bead 7 may be omitted.

In this connection it is essential that the teat is formed on its outside surface with recesses in the form of the grooves 36, 37, 39 or 41 to 44, and with elevations in the form of the fields 40, 48, 49 so that the teat is so improved that the object stated hereinbefore is accomplished.

FIGS. 11 and 12 show in side elevation a nipple 1, a tapered portion 3 and a portion of the teat body. In the embodiment shown in FIG. 11, which is partly sectional, the wall 54 is formed with a waffle pattern comprising grooves 55, 56, 57 so that the wall has portions which differ in wall thickness. That wall may be infolded but upon infolding the beads 58, 59, 60 will bear on each other so that the teat cannot be inverted.

FIG. 11 shows by way of example that the surface of the tapered portion 3 can be profiled so that it is still capable of shaping the lips.

FIG. 12 shows an accordion-like folded portion. In the portion 61 the wafflelike or groove pattern on the outside surface is combined, e.g., with recesses 62, 63, 65, 65. The wall is uniform in thickness and forms internal folds 66, 67, 68, 69 corresponding to the recess 62, 63, 64, 65. This design will result in a higher resistance to a pulling out and inversion. In either case, the deformation is limited in that adjacent wall portions defining a recess bear on each other. In dependence on the design of the grooves, this effect can be obtained in all directions.

FIG. 13 shows a further embodiment of a teat comprising a body 2, a tapered portion 3 and a nipple 1. The tapered portion 3 is formed with external bosses 70, 71, 72, 73, 74 . . . , which merge into the lower end of the nipple 1 and my also be provided on the adjacent portion of the teat body 2. Such dotlike bosses on the outside surface of the teat entrance the simulation of the natural breast of the mother who is ready to feed the baby. Particularly the dotlike bosses and the diamond pattern simulate the surface texture with which the baby is familiar and which can be sensed by him with his lips and fingers.

The teat which has been described can be made from any desired elastomer, particularly from rubber or rubber substitutes or other materials having comparable properties.

What is claimed is:

1. A teat comprising:

an upwardly extending generally cylindrically shaped hollow teat body having an upper end and a lower end and an outside surface and an inside surface, fixing means provided at the lower end of said teat body, a nipple having a lower end spaced upwardly from the upper end of said teat body, and a frusto-conically shaped tapered portion, extending upwardly and inwardly from the upper end of said teat body to the lower end of said nipple, said teat body has a circumferentially extending recess in the outside surface therof located adjacent the upper end thereof and a circumferentially extending bead in the outside surface thereof spaced below said recess, said recess and bead providing a restricted compression of said teat under downwardly directed pressure applied to said nipple, said teat body has a cylindrical first wall portion including said recess and said first wall portion has a uniform wall thickness, said bead has an interrrupted section extending in the circumferential direction, a venting valve formed in said interrupted section and comprising a depression formed in the outside surface of said teat body in said interrupted section of said bead and a slot formed in said teat body within said depression for venting the interior of said teat.

2. The improvement set forth in claim 1, wherein said wall portion is accordionlike at least adjacent to said recess.

3. The improvement set forth in claim 1, wherein said teat body has at least one circumferentially extending annular second wall portion which has a smaller wall thickness than an adjacent wall portion of said teat body and defines a circumferentially extending annular groove on the outside of said teat body.

4. The improvement set forth in claim 3, wherein said teat body has a plurality of said circumferentially extending, annular second wall portions, each of which has a smaller wall thickness than said first wall portion of said teat body and defines a peripherally extending annular groove on the outside surface of said teat body.

5. The improvement set forth in claim 3, wherein said tapered portion has a plurality of said circumferentially extending, annular second wall portions, each of which has a smaller wall thickness than an adjacent wall portion of said tapered portion and defines a peripherally extending annular groove on the outside surface of said tapered portion.

6. The improvement set forth in claim 1, wherein said first wall portion of said teat body comprises wall sections which adjoin each other and extend at an angle to each other and define a flute on the outside surface of said teat body, and said teat body has a larger wall thickness adjacent to said flute than in other portions of said teat body.

7. The improvement set forth in claim 1, wherein said recess is formed by said first wall portion which is zigzag-shaped in longitudinal section.

8. The improvement set forth in claim 1, wherein said tapered portion has an outside surface formed with recesses consisting of crossing grooves and with elevations consisting of fields defined by said grooves.

9. The improvement set forth in claim 8, wherein each of said fields is diamond-shaped and has one pair of opposite corners which are acute-angled and another pair of opposite corners which are obtuse-angled.

10. The improvement set forth in claim 9, wherein said acute-angled corners of each of said fields are spaced apart in the circumferential direction of said teat.

11. The improvement set forth in claim 10, wherein said teat has below said nipple at least in said tapered portion an accordionlike wall portion which is zigzag-shaped in longitudinal section and formed with said crossing grooves and fields.

12. The improvement set forth in claim 8, wherein said tapered portion has the same wall thickness at said grooves and at said fields and is formed on its inside surface with beads corresponding to said grooves.

13. The improvement set forth in claim 8, wherein said crossing grooves and said fields are also formed on the outside surface of said teat body.

14. The improvement set forth in claim 1, wherein the outside surface of said tapered portion is formed with bosses.

15. The improvement set forth in claim 1, wherein said first wall portion which defines said recess is zigzag-shaped in longitudinal sections and includes adjoining wall sections which extend at an angle to each other, one of said wall sections extends downwardly and radially outwardly and defines the lower side of said recess, and said bead constitutes a continuation of said downwardly and radially outwardly extending wall section at the lower end thereof.

16. The improvement set forth in claim 1, wherein the outside surface of said tapered portion is formed with a plurality of recesses which radiate from the lower end of said nipple.

* * * * *